US006309059B1

(12) United States Patent
Ritter

(10) Patent No.: US 6,309,059 B1
(45) Date of Patent: Oct. 30, 2001

(54) CARTRIDGE STOPPER WITH A VALVE FUNCTION

(76) Inventor: Frank Ritter, Pfarrer-Singer-Strasse 1, D-87745 Weiler (Eppishausen) (DE)

( * ) Notice: Subject to any disclaimer, the term of this patent is extended or adjusted under 35 U.S.C. 154(b) by 0 days.

(21) Appl. No.: 09/449,348

(22) Filed: Nov. 24, 1999

(30) Foreign Application Priority Data

Dec. 5, 1998 (DE) ..... 198 56 221

(51) Int. Cl.[7] ..... B41J 2/175; B65D 5/72
(52) U.S. Cl. ..... 347/86; 222/493; 222/496
(58) Field of Search ..... 347/86, 87, 85; 222/95, 325, 326, 327, 492, 493, 494, 496; 137/859

(56) References Cited

U.S. PATENT DOCUMENTS 2,628,004 * 2/1953 Schlicksupp ..... 222/493
4,141,474 * 2/1979 Nilson ..... 222/493

FOREIGN PATENT DOCUMENTS 1 56 379 B 6/1939 (AT) .
19 05 452 11/1964 (DE) .
1 908 821 9/1970 (DE) .
78 18 797 U1 10/1978 (DE) .
197 05 201 C1 4/1998 (DE) .
1 593 084 * 7/1981 (GB) .

* cited by examiner

*Primary Examiner*—Judy Nguyen
(74) *Attorney, Agent, or Firm*—Oliff & Berridge, PLC

(57) ABSTRACT

A cartridge stopper having a valve function, especially for printing ink cartridges made of plastic, includes a valve sleeve that is axially elastic and rests on a mouthpiece neck. The valve sleeve includes a sealing lip that cooperates with a central body, and can move elastically forward (open) when pressure is exerted on the cartridge contents in order to clear a slit opening between the mouthpiece neck and the central body.

21 Claims, 4 Drawing Sheets

CARTRIDGE STOPPER WITH A VALVE FUNCTION

BACKGROUND OF THE INVENTION

1. Field of Invention

The invention relates to a cartridge stopper with a valve function, especially for printing ink cartridges made of plastic.

2. Description of Related Art

Modern printing presses use continuously controlled automatic ink feed to the fountain. For this purpose, plastic cartridges filled with ink are placed in pneumatic extrusion devices mounted on the printer fountain that extrude ink pneumatically pulsewise into the fountain in the quantities required. The cartridges have a cartridge stopper with a valve function (i.e., it also functions as a valve).

Known cartridge stoppers of this type include elastic sealing membranes that act as valves and are cut in a stellate or simple diametral fashion. Such stoppers open when pressure is exerted on the cartridge contents and automatically close again by elastic return when the pressure is relieved. However, such stoppers do not operate satisfactorily as experience has shown.

A number of requirements are placed on such a cartridge stopper with a valve function. For example, to hold and transport the cartridges until they are used and to store opened cartridges until they are used again, the cartridge must be sealed absolutely air-tight to prevent the ink from drying out. Any leak, however small, in the vicinity of the cartridge stopper causes the ink to dry out even to a small extent in the outlet area, clogging the outlet opening and preventing the valve from functioning, and especially making tight re-closure impossible. This poses the unwanted condition of ink cartridges that are still mostly full, becoming useless. This is especially serious when only small quantities of one color are required (at any particular time) for multicolor printing.

Additionally, when the color cartridge is in use, application of pneumatic pressure to the extruding piston is intended to open the seal in order to allow ink to escape and then to close it again as tightly as possible. This function is extremely important for the use of printing ink cartridges in presses with continuously controlled automatic ink feed to the fountain since the ink cartridges remain in place in the pneumatic extrusion devices throughout printing and must supply ink to the fountain without dripping, and in particular with no air being allowed to enter the cartridges between ink extrusion pulses as a result of leaks at the cartridge stopper.

SUMMARY OF THE INVENTION

Hence, it is one aspect of embodiments of the invention to provide a cartridge stopper with a valve function that meets the above-noted requirements in an optimum fashion.

These and/or other aspects can be achieved by providing a cartridge stopper with a valve function, preferably for printing ink cartridges made of plastic, with one or more of the following features. An outwardly convex central body is connected to a mouthpiece neck of a cartridge end wall by inwardly projecting ribs. The mouthpiece neck preferably has a cylindrical end section that extends beyond a connecting area with the ribs, the end section terminating approximately at the circumference of the central body and delimiting a slit opening therewith. Preferably, there is a valve sleeve on the mouthpiece neck. The valve sleeve has a lower (axially inner) part that latches axially with the mouthpiece neck and an upper (axially outer) part connected therewith by wall ribs. The upper part has a sealing lip that cooperates with the central body. The wall ribs produce a connection that is spring-elastic in the axial direction between the lower part and the upper part of the valve sleeve.

The cartridge stopper also can include a sealing lid that fits over the central body, and the valve sleeve and can be screwed onto (or otherwise connected to) the mouthpiece neck.

Each of the wall ribs of the cartridge stopper can have an approximately S-shape, extend between the lower part and the upper part of the valve sleeve, and are positioned around a circumference of the valve sleeve. The S-shaped wall ribs can be arranged in pairs or double pairs with opposite circumferential directional patterns in a plurality of groups distributed at the circumference of the sleeve. The lower (annular) part of the valve sleeve can be made with a plurality of latching openings distributed around the circumference, the openings being latchable over latching protuberances formed at the outer circumference of the mouthpiece neck.

The upper part of the valve sleeve can be made with a U-shaped profile that fits over the upper end area of the mouthpiece neck. The inner U-leg of the U-shaped profile can be formed as an elastic sealing lip cooperating with the inside wall area of the mouthpiece neck. The U-shaped profile of the upper part of the valve sleeve and the profile of the free end of the mouthpiece neck can be designed in complementary fashion so that there is a double linear contact between the two along two concentric annular contact lines.

The stopper lid can have an inside wall area that tensions the sealing lip of the upper part of the valve sleeve against the central body when the stopper lid is screwed on.

When the upper part of the valve sleeve has the U-shaped profile, the stopper lid can have an inside wall area which tensions the U-shaped profile of the upper part of the valve sleeve against the free end of the mouthpiece neck when the stopper lid is screwed onto the mouthpiece neck.

The mouthpiece neck can have on its inside wall surface, a shoulder or transition positioned in such fashion and formed by a change in diameter such that when the valve sleeve is located in a rear (closed) position, the sealing lip cooperates with a larger-diameter inside wall area of the mouthpiece neck, and alternately cooperates with a smaller-diameter inside wall area of the mouthpiece neck located beyond the shoulder or transition when the valve sleeve is deflected axially into an advanced (open) position.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

The drawings have been made on a scale of approximately 3 to 1 and therefore show the cartridge stopper appropriately enlarged to make the details more clearly visible.

Figure 1:
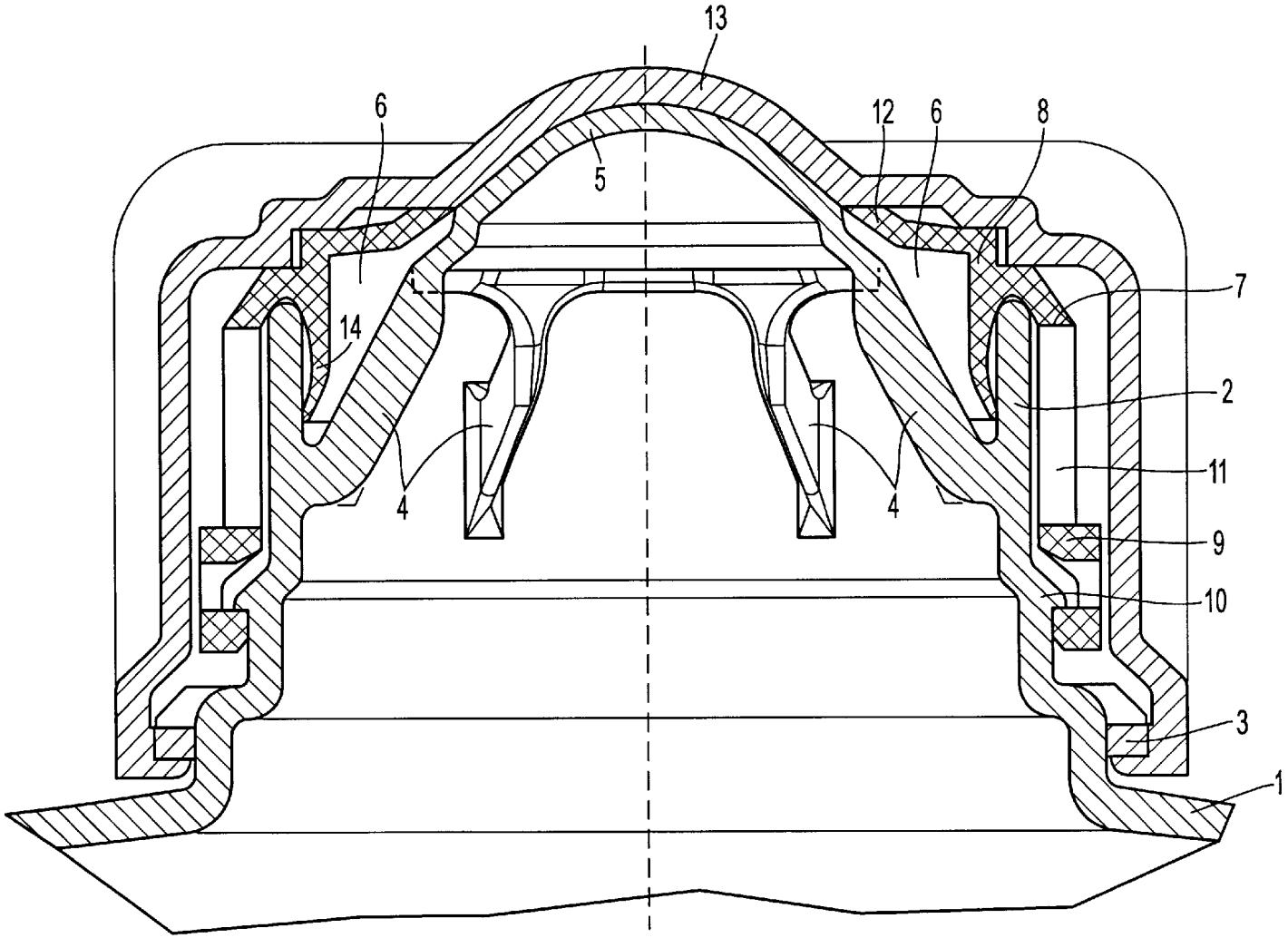
FIG. 1 shows a cartridge stopper according to an embodiment of the invention in an axial section in the closed state.
Figure 2:
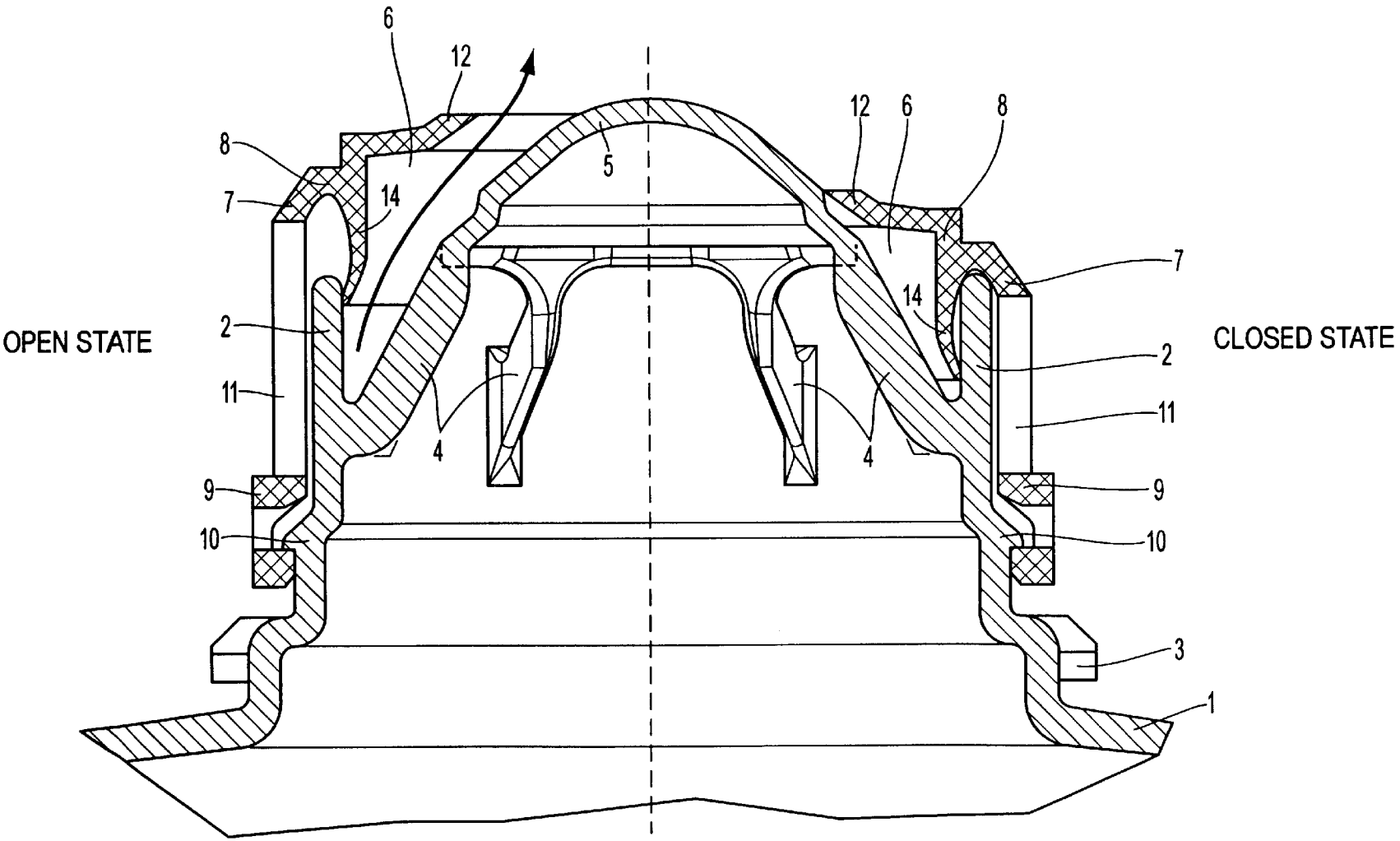
FIG. 2 shows an axial section similar to FIG. 1, but with the stopper lid removed, with the right half section showing the cartridge stopper in the closed state and the left half section showing the cartridge stopper in the open state.

In the axial section according to FIGS. 1 and 2, a section of end wall 1 of the cartridge is shown, with integrally molded mouthpiece neck 2. A multi-pitch screw thread 3 is formed externally on mouthpiece neck 2. In addition, ribs 4 are provided, formed integrally with mouthpiece neck 2 and projecting radially inward. The ribs 4 have a central body 5 likewise made in one piece, the body having the approximate shape of a segment of a sphere or a convex shape. Ink can flow between ribs 4 to the outlet opening of the cartridge mouthpiece, which is formed by the mouthpiece neck in the central body and has the shape of an annular slit opening 6, located between mouthpiece neck 2 and central body 5.

Figure 3:
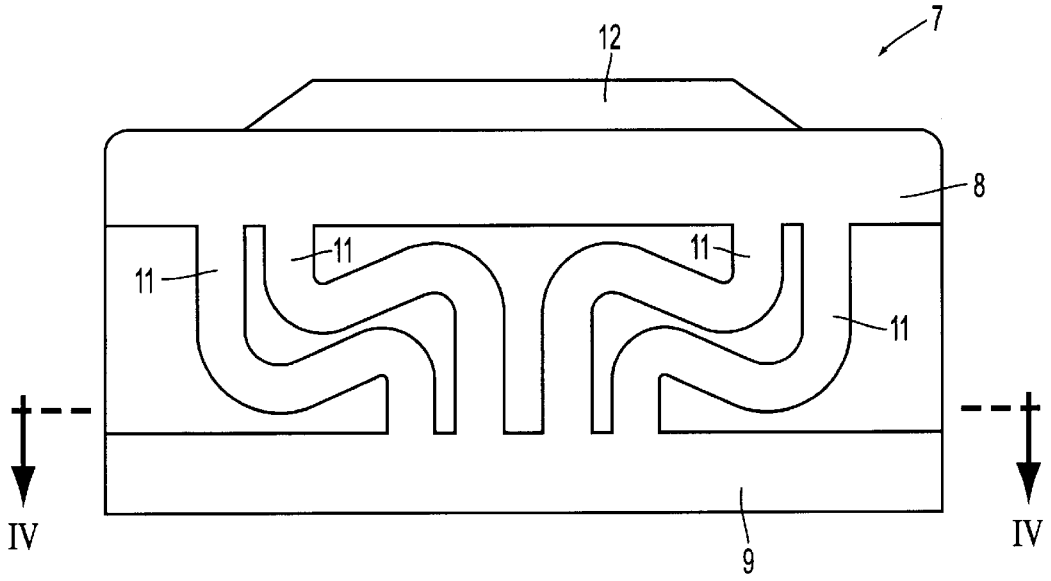
FIG. 3 shows the valve sleeve of the cartridge stopper according to FIG. 1 and 2 in a side view.
Figure 4:
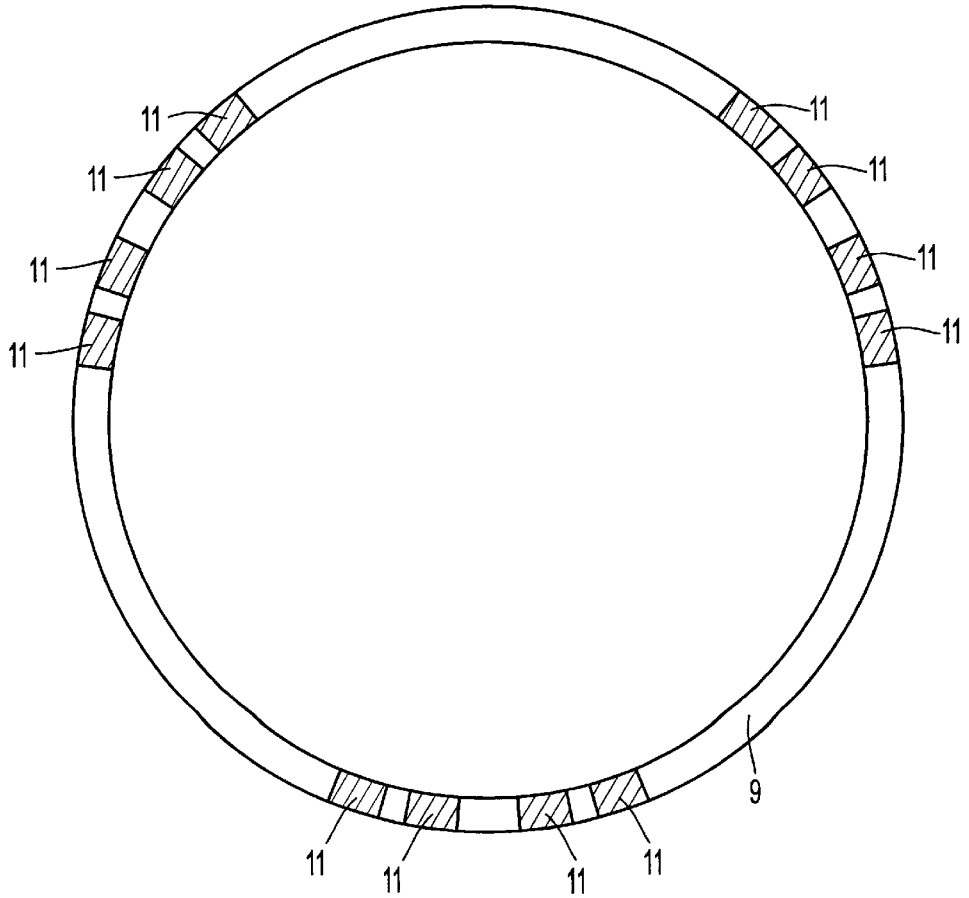
FIG. 4 shows the valve housing according to FIG. 3 in cross section in plane IV—IV in FIG. 3.

The valve sleeve 7, shown in a side view in FIG. 3 and in cross section in FIG. 4, is placed on mouthpiece neck 2. This valve sleeve 7 includes an upper (axially outer) part 8 which, as FIGS. 1 and 2 show, fits over the upper edge of mouthpiece neck 2 and has a U-shaped profile whose inner leg forms an elastic sealing tip 14 that is radially outwardly convex in the approximate form of an arc and tapers toward its free end. The elastic sealing lip 14 abuts against the inside wall of mouthpiece neck 2 in a sealing fashion. Valve sleeve 7 also includes a lower (axially inner) part 9 that is annular and latches behind a plurality of latching protuberances 10 formed above the threads 3 on the outside of the mouthpiece neck 2. Upper part 8 and annular part 9 of the valve sleeve 7 are connected with one another by groups of S-shaped wall ribs 11 that have shapes shown in FIG. 3. A cross section shown in FIG. 4 shows that three groups of the S-shaped ribs 11 are distributed on the circumference of valve sleeve 7.

The shape of ribs 11 visible in FIG. 3, as can easily be seen, produces a certain axial elasticity of the valve sleeve 7 in the sense that upper part 8 and annular part 9 can be moved apart axially to a certain extent, with S-shaped wall ribs 11 acting as leaf springs to pull them back together.

Upper part 8 of valve sleeve 7 has a lip 12 that extends conically and projects inwardly. As shown in FIGS. 1 and 2, lip 12 cooperates as a sealing lip with central body 5 of the cartridge mouthpiece.

A sealing lid 13 can be screwed, as shown in FIG. 1, onto screw thread 3 of mouthpiece neck 2. The lid 13 ensures absolutely air-tight closure of the cartridge mouthpiece when the cartridge is not in use. The sealing lid can be attached to the mouthpiece neck 2 by connecting structure other than screw threads, e.g., by a snap connector.

The function of the cartridge stopper with valve function will now be explained. Pressure exerted on the cartridge contents (after sealing lid 13 has been removed), for example, from a pneumatic drive, is transmitted through annular gap 6 between mouthpiece neck 2 and central body 5 and on upper part 8 (having the lip 12) of valve sleeve 7. Annular part 9 of valve sleeve 7 is firmly latched behind latching protuberances 10 of the mouthpiece neck and therefore cannot move axially. Under the prevailing pressure, however, as a result of the axial elasticity of valve sleeve 7 due to the shape of S-shaped ribs 11, upper part 8 is advanced axially, causing an annular gap to open between lip 12 and central body 5 and allowing ink to emerge. This state is shown in the left half section of FIG. 2, while the right half section shows the closed state.

The axial movement of upper part 8 of the valve sleeve 7 during the opening process occurs as a result of the fact that upper part 8 is guided and slides on the part of the mouthpiece neck 2 that projects (axially) outward and upward from the connection with ribs 4. Since this projecting end part of mouthpiece neck 2 is surrounded by the U-shaped profile of valve sleeve upper part 8, the inner sealing lip 14 slides on the inner wall of the mouthpiece neck 2.

If the pressure on the cartridge contents is relieved, the restoring force of the ribs 11, which act as springs, produce a restoring movement of the valve sleeve upper part 8 and hence a re-application of lip 12 to central body 5, closing the gap opening (right half section in FIG. 2).

A sealing lid 13 shown in FIG. 1 can be screwed by a matching multi pitch internal thread on the multi pitch external screw thread 3 of mouthpiece neck 2 to ensure the absolutely air-tight closing of the cartridge for holding and transport until the cartridge is used, and for storing an opened cartridge. Sealing lid 13 presses lip 12 of valve sleeve 7 firmly against central body 5 and also abuts matching surfaces of valve sleeve upper part 8. As can be seen from FIG. 1, the inside wall of sealing lid 13, at two staggered annular areas, abuts matching end surface areas of valve sleeve 7 at points which correspond in their radial positions to the position of the U-shaped profile of valve sleeve upper part 8 and the end of the mouthpiece neck cooperating therewith, so that the U-shaped profile of the valve sleeve upper part 8 is pressed firmly against the end of mouthpiece neck 2. As can be seen from FIGS. 1 and 2, the inside radius of curvature of the U-shaped profile is smaller than the outside radius of curvature of the mouthpiece neck end 2, so that cooperation takes place along two lines of contact. A comparison of the right half section in FIG. 2 with the axial section in FIG. 1 clearly shows the difference between the relative positions of the U-shaped profile of the valve sleeve upper part 8 and the mouthpiece neck 2 when sealing lid 13 is removed (FIG. 2) and with the valve sleeve compressed by the screwed-on sealing lid 13 (FIG. 1).

Figure 5A:
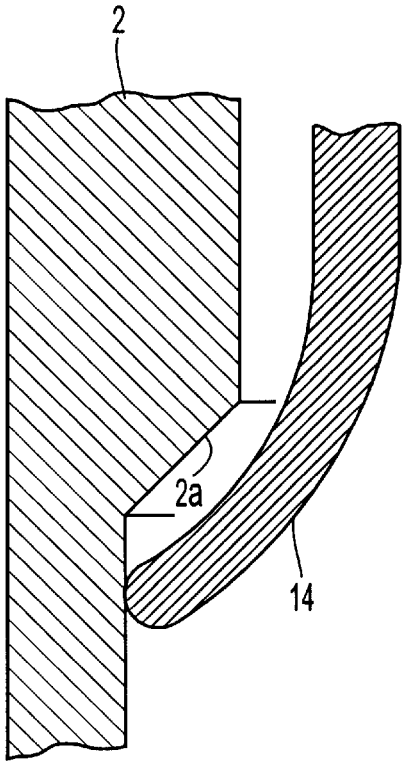
FIGS. 5A and 5B show the seal in detail.
Figure 5B:
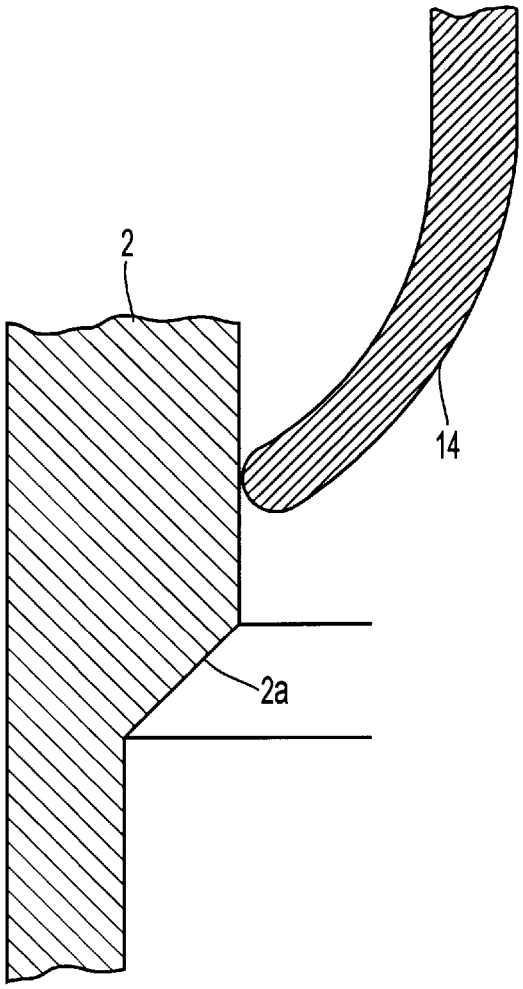

FIGS. 5A and 5B show in detail an advantageous improvement on the arrangement of mouthpiece neck 2 and sealing lip 14 of valve sleeve 7 in a considerably magnified view. FIG. 5A shows the position of sealing lip 14 in the closed position of valve sleeve 7 and FIG. 5B shows the position of sealing lip 14 with valve sleeve 7 in the open position.

As one can see, the inside wall surface of mouthpiece neck 2 has a shoulder 2*a* in the form of a diagonal ramp, so that the inside diameter of the mouthpiece neck expands from a narrower diameter in the upper area to a slightly larger diameter in the lower area. Shoulder 2*a* is located so that when valve sleeve 7 is in the closed position, sealing lip 14 abuts the inside wall area with the larger diameter, but during the opening movement of valve sleeve 7, sealing lip 14 slides over shoulder 2*a* into the wall area of mouthpiece neck 2 with the smaller inner diameter.

Thus, the effect is obtained that sealing lip 14 abuts the mouthpiece neck inside wall with greater pretensioning in the open position of valve sleeve 7 than in its closed position. This is advantageous because valve sleeve 7 is opened by exerting pressure on the cartridge contents and the seal is more critical when a greater pressure is applied to the cartridge contents than when the pressure on the cartridge contents is relieved, which occurs when valve sleeve 7 is in the closed position and sealing lip 14 assumes the position shown in FIG. 5A. The fact that sealing lip 14 is more relaxed in this closed position than in the open position shown in FIG. 5B also has the advantage that the tension on sealing lip 14 does not fall as a result of flow processes in the molecular structure of the plastic material that take place over time.

While the present invention has been described with reference to preferred embodiments thereof, it is to be understood that the invention is not limited to the disclosed embodiments or constructions. To the contrary, the invention is intended to cover various modifications and equivalent arrangements. In addition, while the various elements of the disclosed invention are shown in various combinations and configurations, that are exemplary, other combinations and configurations, including more, less or only a single element, are also within the spirit and scope of the invention.

What is claimed is:

1. A cartridge stopper having a valve function, comprising:

(a) an outwardly convex central body connected to a mouthpiece neck of a cartridge end wall by ribs;

(b) the mouthpiece neck having a cylindrical end section that extends axially beyond a connecting area with the ribs, the cylindrical end section terminating approximately at a circumference of the central body and delimiting a slit opening with the circumference of the central body;

(c) a valve sleeve mounted on the mouthpiece neck and having an axially inner part connected with the mouthpiece neck, and an axially outer part connected with the axially inner part by wall ribs, the axially outer part having a sealing lip cooperating with the central body, the axially outer part being axially movable relative to the axially inner part; and (d) the wall ribs produce a connection that is elastic in the axial direction and extending between the axially inner part and the axially outer part of the valve sleeve without extending in a radial direction that is perpendicular to the axial direction.

2. A cartridge stopper according to claim 1, further comprising a sealing lid that fits over the central body and the valve sleeve, and that is removably connectable to the mouthpiece neck.

3. A cartridge stopper according to claim 1, wherein each of the wall ribs has an approximately S-shape.

4. A cartridge stopper according to claim 3, wherein the S-shaped wall ribs are arranged in pairs or double pairs with opposite circumferential directional patterns in a plurality of groups distributed at a circumference of the valve sleeve.

5. A cartridge stopper according to claim 1, wherein the axially inner part of the valve sleeve includes a plurality of latching openings distributed around its circumference, the openings being latchable over latching protuberances formed at the outer circumference of the mouthpiece neck.

6. A cartridge stopper according to claim 1, wherein the axially outer part of the valve sleeve has a U-shaped profile that slideably fits over a free end of the mouthpiece neck.

7. A cartridge stopper according to claim 6, wherein an inner U-leg of the U-shaped profile forms an elastic sealing lip that cooperates with an inside wall area of the mouthpiece neck.

8. A cartridge stopper according to claim 6, wherein the U-shaped profile of the axially outer part of the valve sleeve and a profile of the free end of the mouthpiece neck are shaped in a complementary fashion so that there is a double linear contact therebetween along two concentric annular contact lines.

9. A cartridge stopper according to claim 2, wherein the sealing lid has an inner wall area that tensions the sealing lip of the axially outer part of the valve sleeve against the central body when the sealing lid is connected to the mouthpiece neck.

10. A cartridge stopper according to claim 6, further comprising a sealing lid that fits over the central body and the valve sleeve, and that is removably connectable to the mouthpiece neck, the sealing lid having an inner wall area that tensions the U-shaped profile of the axially outer part of the valve sleeve against the free end of the mouthpiece neck when the sealing lid is connected to the mouthpiece neck.

11. A cartridge stopper according to claim 1, wherein the mouthpiece neck has on its inside wall surface a shoulder located at a change in inner diameter of the mouthpiece neck, the shoulder positioned such that when the valve sleeve is located in a closed position, the sealing lip cooperates with a larger-inner-diameter wall area of the mouthpiece neck, and the sealing lip cooperates with a smaller-inner-diameter wall area of the mouthpiece neck located beyond the shoulder when the valve sleeve is moved axially into an open position.

12. An ink cartridge stopper comprising:

(a) a mouthpiece neck having an axially outer end section;

(b) a central body located radially inward of the mouthpiece neck and having an outer circumference, the outer circumference spaced from the axially outer end section of the mouthpiece neck to form an outlet of the ink cartridge stopper between the outer circumference and the axially outer end section;

(c) a valve sleeve mounted on the mouthpiece neck, the valve sleeve having an axially inner part and an axially outer part movably connected to the axially inner part by an elastic coupling that extends between the axially inner and outer parts, the axially outer part having a sealing lip that is engageable with the central body to close the outlet of the ink cartridge stopper when the axially outer part is in a closed position; and (d) the elastic coupling biasing the axially outer part toward the axially inner part and into the closed position, wherein the axially outer part is movable in an axial direction relative to the axial inner part, and the elastic coupling extends substantially parallel to the axial direction.

13. A cartridge stopper according to claim 12, further comprising a sealing lid that fits over the central body and the valve sleeve, and that is removably connectable to the mouthpiece neck.

14. A cartridge stopper according to claim 12, wherein the elastic coupling includes a plurality of S-shaped ribs.

15. A cartridge stopper according to claim 12, wherein the axially inner part of the valve sleeve includes a plurality of latching openings distributed around its circumference, the openings being latchable over latching protuberances formed at an outer circumference of the mouthpiece neck.

16. A cartridge stopper according to claim 12, wherein the axially outer part of the valve sleeve has a U-shaped profile that slideably fits over a free end of the mouthpiece neck.

17. A cartridge stopper according to claim 16, wherein an inner U-leg of the U-shaped profile forms an elastic sealing lip that cooperates with an inside wall area of the mouthpiece neck.

18. A cartridge stopper according to claim 16, wherein the U-shaped profile of the axially outer part of the valve sleeve and a profile of the free end of the mouthpiece neck are shaped in a complementary fashion so that there is a double linear contact therebetween along two concentric annular contact lines.

19. A cartridge stopper according to claim 13, wherein the sealing lid has an inner wall area that tensions the sealing lip of the axially outer part of the valve sleeve against the central body when the sealing lid is connected to the mouthpiece neck.

20. A cartridge stopper according to claim 16, further comprising a sealing lid that fits over the central body and the valve sleeve, and that is removably connectable to the mouthpiece neck, the sealing lid having an inner wall area that tensions the U-shaped profile of the axially outer part of the valve sleeve against the free end of the mouthpiece neck when the sealing lid is connected to the mouthpiece neck.

21. A cartridge stopper according to claim 12, wherein the mouthpiece neck has on its inside wall surface a shoulder located at a change in inner diameter of the mouthpiece neck, the shoulder positioned such that when the valve sleeve is located in the closed position, the sealing lip cooperates with a larger-inner-diameter wall area of the mouthpiece neck, and the sealing lip cooperates with a smaller-inner-diameter wall area of the mouthpiece neck located axially outward of the shoulder when the valve sleeve is moved axially into an open position.

* * * * *